US006268795B1

(12) United States Patent
Hadfield

(10) Patent No.: US 6,268,795 B1
(45) Date of Patent: Jul. 31, 2001

(54) SECURITY TAG FOR USE IN PREVENTING THEFT OF AN ARTICLE

(75) Inventor: George Hadfield, Kent (GB)

(73) Assignee: Advanced Technology Communications Limited, Tonbridge Kent (GB)

( * ) Notice: Subject to any disclaimer, the term of this patent is extended or adjusted under 35 U.S.C. 154(b) by 0 days.

(21) Appl. No.: 09/509,113

(22) PCT Filed: Sep. 28, 1998

(86) PCT No.: PCT/GB98/02913

§ 371 Date: Mar. 23, 2000

§ 102(e) Date: Mar. 23, 2000

(87) PCT Pub. No.: WO99/17261

PCT Pub. Date: Apr. 8, 1999

(30) Foreign Application Priority Data

Sep. 29, 1997 (GB) ..... 9720674
Sep. 30, 1997 (GB) ..... 9727472

(51) Int. Cl.[7] ..... G08B 13/14

(52) U.S. Cl. ..... 340/568.1; 340/568.2; 340/568.4; 340/572; 340/573; 340/539

(58) Field of Search ..... 340/568.1, 568.2, 340/568.4, 572, 573, 539

(56) References Cited

U.S. PATENT DOCUMENTS

| | | | | |
|---|---|---|---|---|
| 4,000,488 | | 12/1976 | Ephraim | 340/280 |
| 5,574,430 | | 11/1996 | Ott et al. | 340/568 |
| 5,574,470 | * | 11/1996 | De Vall | 340/895 |
| 5,644,295 | * | 7/1997 | Connolly et al. | 340/568 |
| 5,751,256 | * | 5/1998 | McDonough et al. | 343/873 |
| 5,910,768 | * | 6/1999 | Ott | 340/568.2 |

FOREIGN PATENT DOCUMENTS

| | | |
|---|---|---|
| 2405526 | 5/1979 | (FR) . |
| 2287339 | 9/1995 | (GB) . |
| 2291733 | 1/1996 | (GB) . |

* cited by examiner

*Primary Examiner*—Daniel J. Wu
*Assistant Examiner*—Tai T. Nguyen
(74) *Attorney, Agent, or Firm*—Dowell & Dowell, P.C.

(57) ABSTRACT

A security device includes a security tag and a monitoring circuit for monitoring an electrical characteristic of a conductive track formed on a flexible substrate of the tag. The substrate includes an adhesive backing for bonding the substrate to a surface, the elasticity of the substrate and the bonding strength of the adhesive being selected such that, with the substrate adhesively bonded to the surface, the force required to stretch the substrate is less than the adhesive bonding force holding the substrate against the surface.

15 Claims, 5 Drawing Sheets

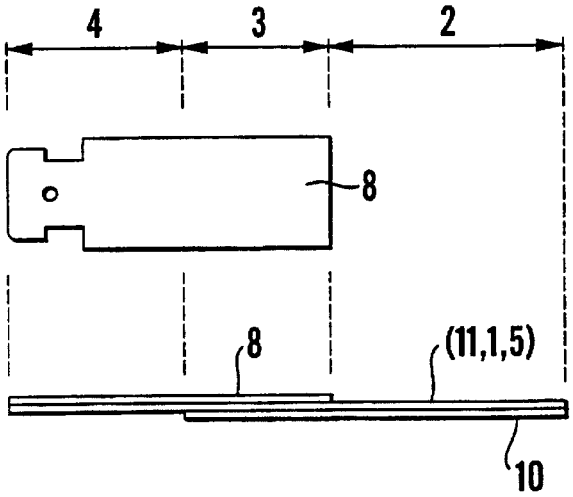
Fig.6
Fig.6a
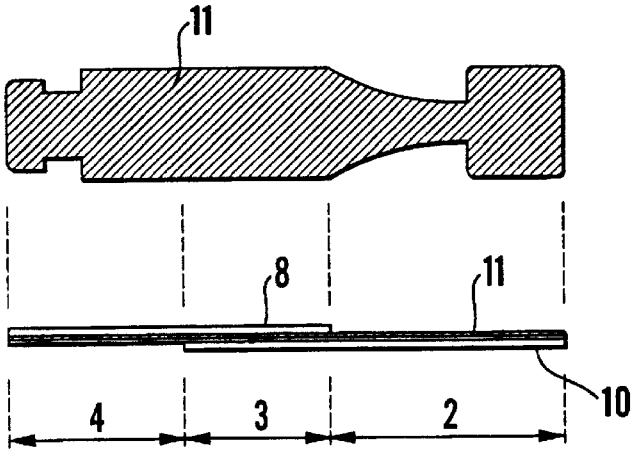
Fig.7
Fig.7a
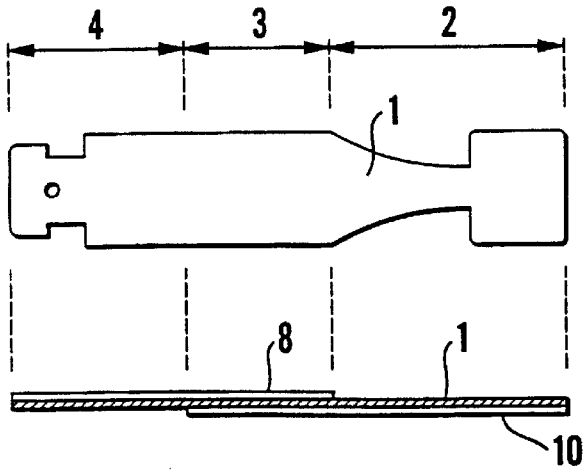
Fig.8
Fig.8a

SECURITY TAG FOR USE IN PREVENTING THEFT OF AN ARTICLE

BACKGROUND OF THE INVENTION

1. Field of the Invention

The present invention relates to a security device including a security tag for fixing to a surface such that relative movement between the tag and the surface can be detected. The device may also include a monitoring circuit for monitoring an electrical characteristic of the tag such that an alarm is triggered when relative movement is detected.

2. Description of Related Art

In shops where valuable items are on display there is a need to prevent or inhibit theft of the items. A known security tag used for this purpose comprises a flexible substrate with an adhesive backing for bonding a head portion of the substrate to the surface of an item being protected: and an electrically conductive track defining a circuit between two locations on the tag, at least part of the conductive track being located between the substrate and the adhesive backing.

The tag has a release layer adjacent the conductive track so arranged that, when an attempt is made to peel the tag away from a surface to which the head portion is fixed, some portions of the track remain bonded to the substrate while others remain bonded to the adhesive layer. The circuit is thus disrupted and the change in resistance is used to trigger an alarm.

This device has several problems. For example, it is designed as a disposable item and is relatively expensive to manufacture due to the number of manufacturing processes. Moreover, the device has to be manufactured within strict electrical tolerances for its most commonly used application, and this results in a relatively high proportion of rejects during manufacture. The device also relies on the properties of the release layer (ink) which can alter during drying.

SUMMARY OF THE INVENTION

According to the present invention from one aspect there is provided a security tag comprising an electrically conductive track formed on a flexible substrate, the substrate including an adhesive backing for bonding the substrate to a surface, the elasticity of the substrate and the bonding strength of the adhesive being selected such that, with the substrate adhesively bonded to the surface, the force required to stretch the substrate is less than the adhesive bonding force holding the substrate against the surface.

Accordingly, the substrate will stretch before it separates from the surface. The stretching of the substrate preferably changes an electrical characteristic, such as the resistance of the electrically conductive track by an amount which is detected by a monitoring circuit monitoring this characteristic of the track. If the monitoring circuit detects that the value of the characteristic lies outside predetermined upper and lower limit values, an alarm is triggered. For example, the width of the track may be narrowed as the track stretches with the substrate, and the resistance of the track thereby increases. If the increase exceeds a predetermined upper limit, the alarm is triggered.

Preferably, to increase sensitivity and to provide a more robust tag with improved handling properties, the substrate further includes a non-elastic, or at least less elastic, layer of material bonded to a portion of the substrate overlying the adhesive backing and preferably extending beyond the adhesive backing, the extended portion of the substrate preferably including terminal contacts at each end of the conductive track which are used to connect the tag to the monitoring circuit.

The substrate preferably comprises a soft stretchable material, such as self-cling PVC.

The non-stretch or less elastic portion of the substrate is preferably achieved by laminating a less elastic material to the material forming the elastic portion of the substrate.

The conductive track may have a substantially uniform width along its length, and a portion of the track is then elongated in response to the stretching of a corresponding portion of the substrate on which the track is formed. The elongation is accompanied by a corresponding narrowing of the track which increases its resistance.

Alternatively, improved performance is achieved by increasing the resistance of the conductive track along a predetermined portion of its length and by arranging that the substrate is stretched in an area that includes this predetermined portion of the track. The increased resistance is preferably achieved by reducing the cross-sectional area of a length of the track, either by narrowing its width or reducing its thickness. The substrate is preferably shaped so that the force tending to stretch the substrate is concentrated in the area that includes this length of track. Moreover, the track may be stretched to a point at which the track fractures and an open circuit is created.

In one particular embodiment, the conductive track has a first width over a first portion of the substrate and a second width over a second portion of the substrate, the first width exceeding the second width and the elasticity of the first portion of the substrate being less that of the second portion. The narrower width track therefore lies on the more elastic portion of the substrate.

The elasticity of the material forming the conductive track can be made less than that of the elastic substrate. For example, if the track consists of an ink printed on the substrate, the elasticity of the printed ink can be made less than that of the substrate whereby the ink fractures when the substrate is stretch beyond a predetermined limit. The monitoring circuit may then detect an open circuit. The ink preferably comprises a mixture of graphite and silver inks, and the amount of silver can be adjusted to achieve the required resistance and elasticity.

BRIEF DESCRIPTION OF THE DRAWINGS

In the accompanying drawings, by way of example only:

FIG. 6 illustrates the top layer of a third security tag embodying the present invention;

FIG. 6*a* is a diagrammatic side view of the third tag showing the position of the top layer;

FIG. 7 illustrates an upper middle layer of the third tag;

FIG. 7*a* is a diagrammatic side view showing the position of the upper middle layer;

FIG. 8 illustrates a central middle layer of the third tag;

FIG. 8*a* is a diagrammatic side view showing the position of the central middle layer;

DESCRIPTION OF THE PREFERRED EMBODIMENT

Figure 1:
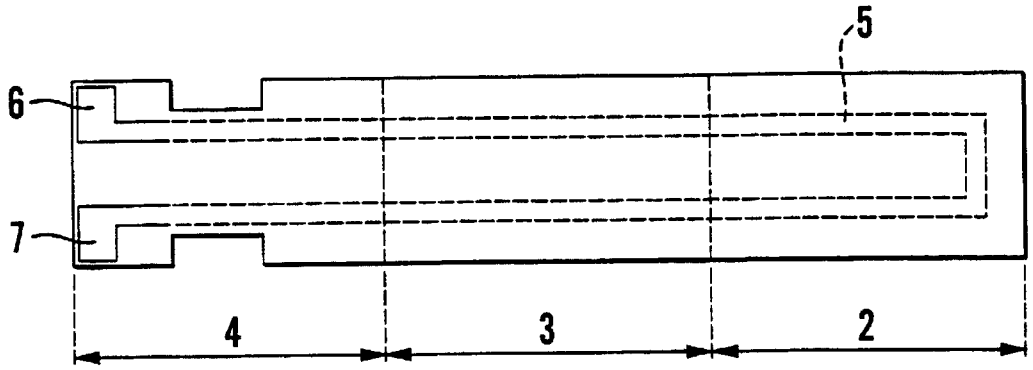
FIG. 1 is a schematic plan view of a first security tag embodying the invention.
Figure 3:
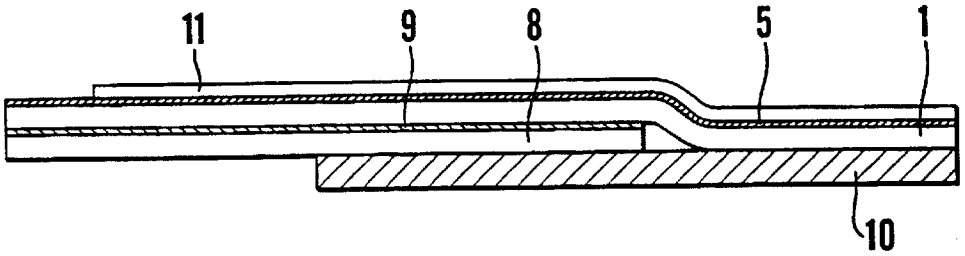
FIG. 3 is a side view of the tag of FIG. 1.
Figure 2:
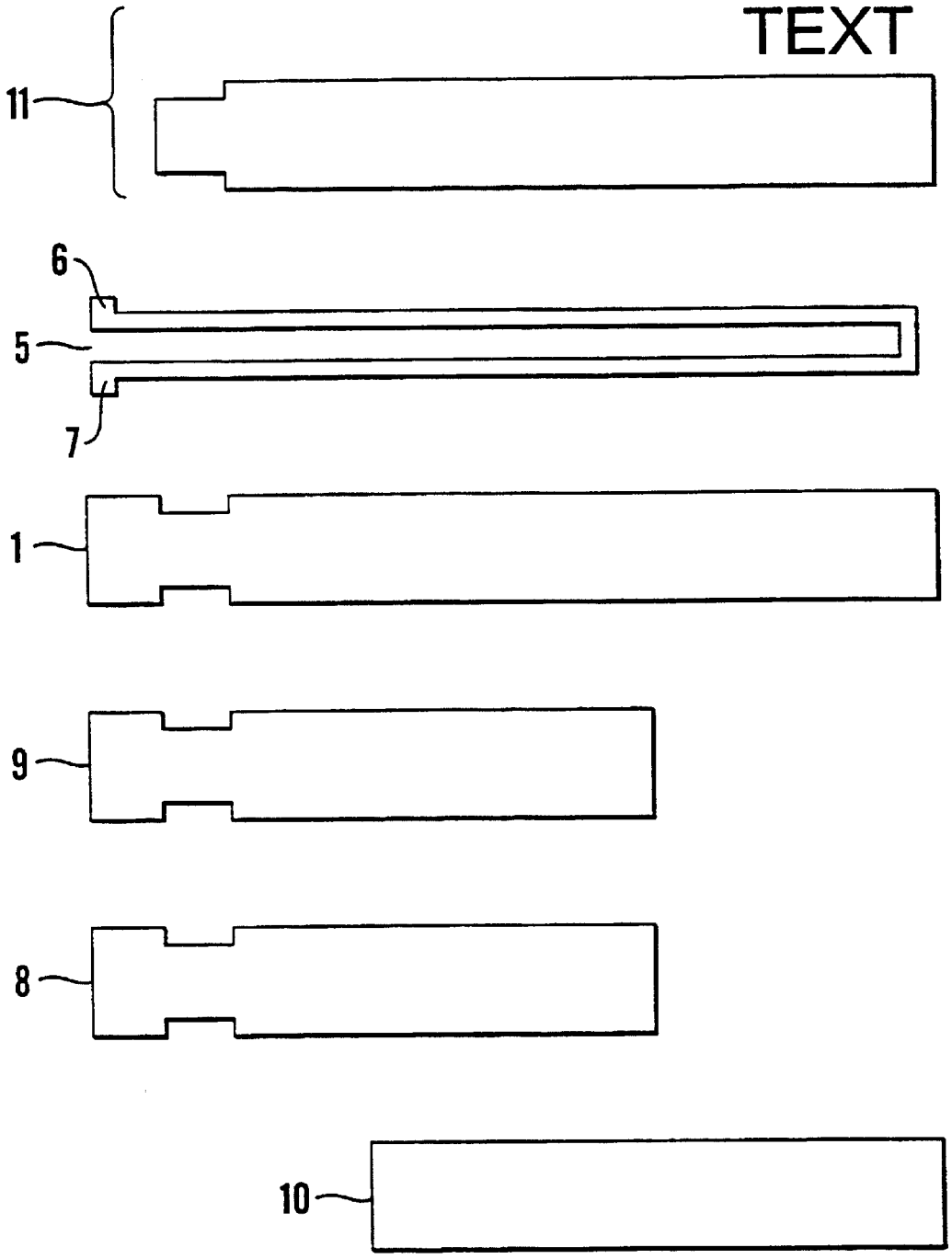
FIG. 2 is an exploded view of the tag of FIG. 1.

Referring to these drawings, the tag shown in FIGS. 1 to 3 has a head portion 2, a center section 3, and a tail portion 4 for electrical connection to a monitoring circuit. An electrically conductive track 5 extends from a contact 6 at the distal end of the tail portion 4, down the length of the tag, around the head portion 2 and back to a contact 7 in the tail portion. The track 5 is formed on a soft elastic substrate 1. Laminated to a portion of the soft elastic substrate 1 is a secondary non-elastic substrate 8 which is less elastic and is preferably supplied with its own laminating adhesive 9. This secondary non-elastic substrate 8 and adhesive 9 add rigidity to the center section 3 and the tail portion 4 of the tag and prevent it stretching during normal handling.

A double-sided adhesive 10 bonds the center section 3 and the head portion 2 to the surface of an item being protected.

Graphic inks 11 are added over the conductive track for aesthetic appeal and physical protection. They may also conceal the lower layers of the tag.

In use, when the tag is fixed to a surface and an attempt is made to remove it from the surface, the center section 3 may overcome the adhesive bond and pull away from the surface but the head section 2 will stretch before the adhesive bond is broken. The resulting stretching of the conductive track 5 produces an altered resistive value which is detected by the monitoring circuit. The rate of change of the resistive value, and/or the magnitude of the change would be of a different order compared to resistive changes caused by temperature variations and can thereby be used to trigger an alarm.

The elastic substrate 1 is a thin stretchable material which can accept printing inks. It can be made, for example, of PVC (particularly soft self-cling PVC), cold cast polypropylene, polythene or paper. On the upper side is printed an electrically conductive ink to form the conductive track 5. On top of the conductive ink 5 scuff graphic inks 11 are printed to form the graphic layers and conceal the lower layers. The graphic ink 11 is not printed over the contacts 6 and 7 to allow for electrical connection. The graphic ink layers 11 also provide protective insulation and prevent any attempt at either reading or shorting the device with the correct resistive value.

Below the tail and center portion of the primary substrate a secondary non-elastic substrate 8 is laminated. This material could be made, for example, of rigid PVC, polyester, polycarbonate, paper or card.

The double-sided adhesive 10 has a bonding strength greater than the force needed to stretch the head portion 2. The double-sided adhesive 10 could be, for example, an epoxy or acrylic glue, such as Technibond T370 or T555 which are doubled-sided and have a flexible carrier to aid molding to textured surfaces.

Figure 5:
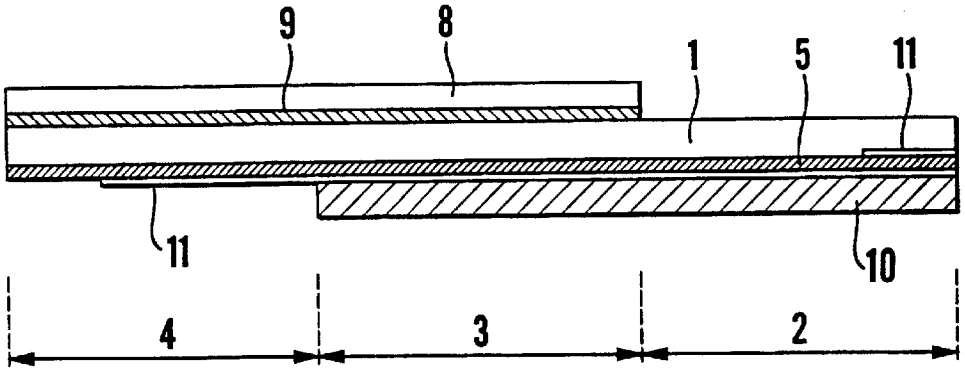
FIG. 5 is a side view of the tag of FIG. 4.
Figure 4:
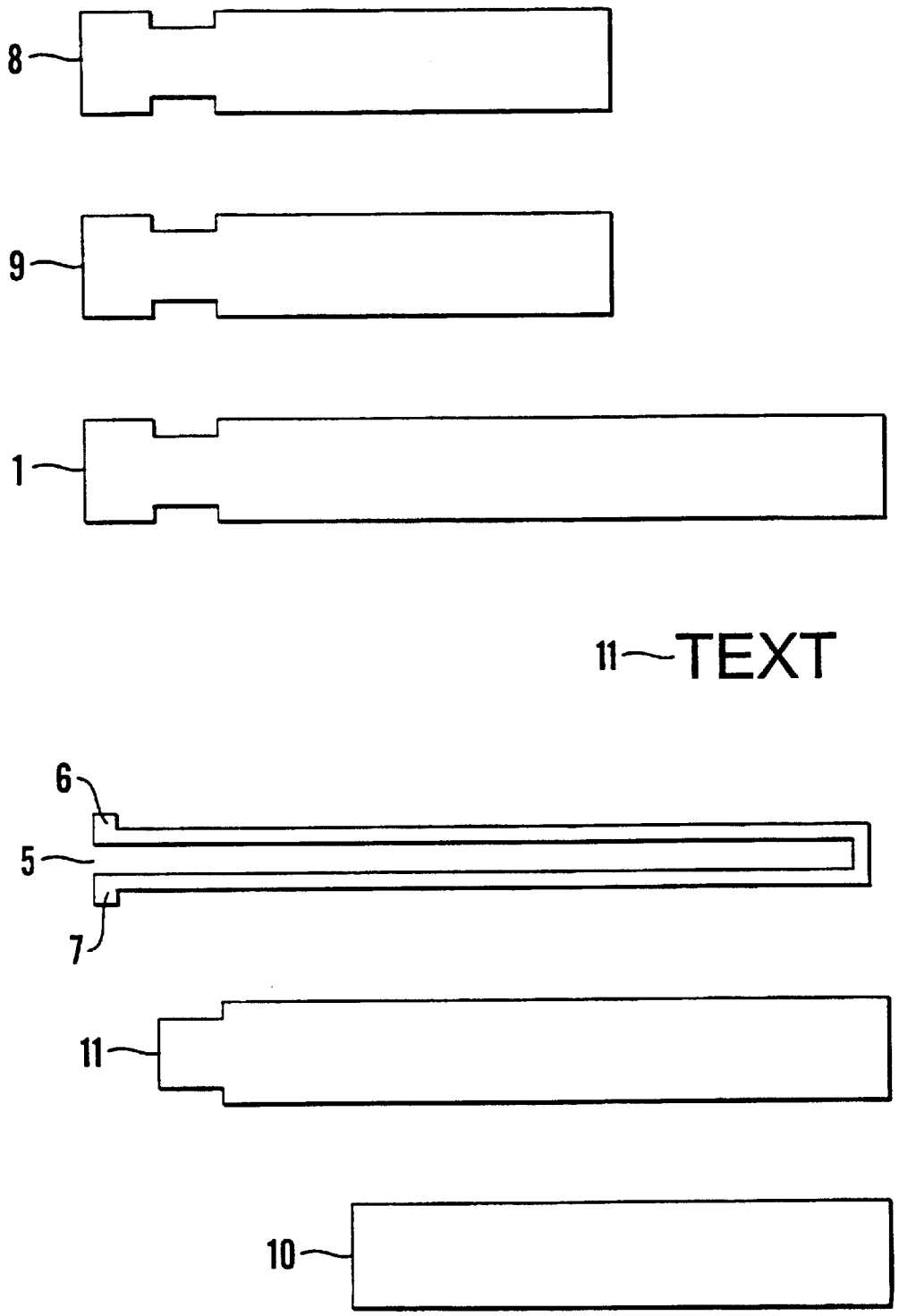
FIG. 4 is an exploded view of a second security tag embodying the invention.
Figure 9:
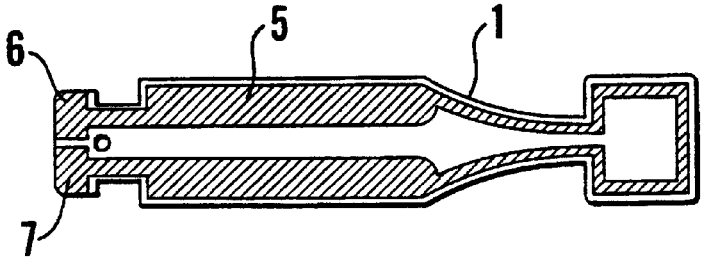
FIG. 9 illustrates a lower middle layer of the third tag.
Figure 9A:
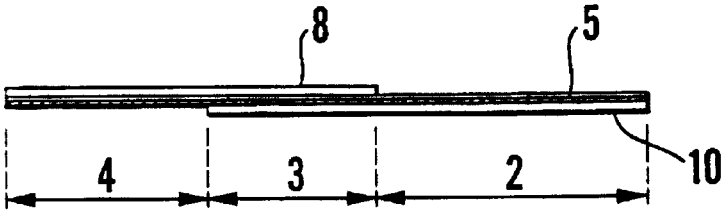
FIG. 9*a* is a diagrammatic side view showing the position of the lower middle layer.
Figure 10:
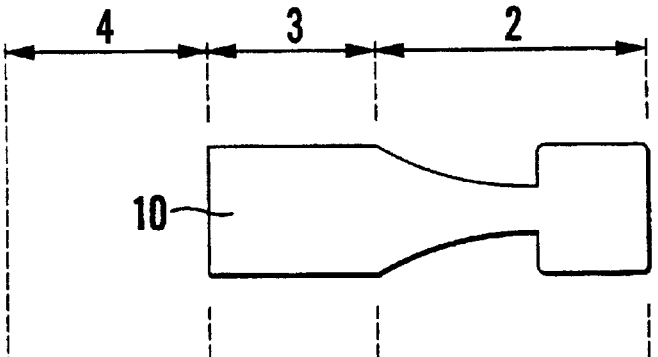
FIG. 10 illustrates a bottom layer of the third tag.
Figure 10A:
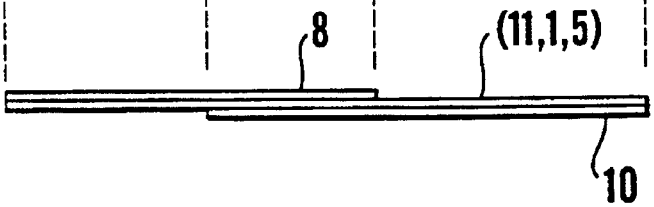
FIG. 10*a* is a diagrammatic side view showing the position of the bottom layer.

The tag shown in FIGS. 4 and 5 is similar to the tag shown in FIGS. 1 to 3 and like parts are numbered identically.

The order of the layers is different, but each have the same function as in FIGS. 1–3. The tag shown in FIGS. 1 to 3 can have opaque or transparent substrates 1 and 8, whereas the tag shown in FIGS. 4 and 5 may have transparent substrates 1 and 8 so that the graphic ink layers 11 can be viewed.

The tag of FIGS. 4 and 5 has the secondary non-elastic substrate 8 on top of the main elastic substrate 1, and the ink layers 5 and 11 are printed on the underside of the elastic substrate. The double-sided adhesive 10 remains in the same location.

The tag shown in FIGS. 6–10 is formed in a similar manner to that of FIGS. 1–3 or FIGS. 4–5, but improved performance is achieved by varying the width of the conductive track and modifying the shape of the tag to ensure that the conductive track is stretched in an area where the resistance is a maximum. In particular, the head portion 2 of the tag is necked.

With this arrangement, the necked head portion of the tag is the portion most susceptible to stretching, and stretching of this portion will produce maximum effect because the track width is reduced and a high proportion of the total resistance is therefore concentrated in this area.

Referring particularly to FIGS. 6–10, like parts are again numbered identically and the tag consists of a primary substrate 1 (FIG. 8) extending the length of the tag and consisting of 125 micron clear self-cling PVC. The top surface of the self-cling PVC is printed with graphic ink 11 (FIG. 7) while the underside is printed with a mixture of carbon and silver inks to form the conductive track 5 shown in FIG. 9. Alternatively, the underside is printed with the graphic ink 11 and then with the mixture of carbon and silver inks to form the conductive track 5.

The graphic ink is preferably a dark ink and may be printed with clear areas forming alphanumeric characters providing information about the tag. A white graphic ink is then washed over the dark ink to fill the clear areas and increase the visibility of the characters when viewed through the clear PVC.

It can be seen that the width of the conductive track 5 varies, and in the head section 2 of the tag, the track is made as narrow as possible. The resistance of the track is therefore a maximum in this area of the tag.

At the same time, it can be seen that the head section 2 of the tag is necked so that the tag will stretch preferentially in this area if subjected to a tensile force. Stretching, therefore, occurs in the area where the resistance of the track is a maximum.

A top layer 8 of non-elastic, adhesive-backed 125 micron clear polyester is then bonded to the self-cling PVC over the tail section 4 and center section 3 of the tag, while a bottom layer 10 of adhesive with a peelable backing paper (not shown) is bonded to the underside of the self-cling PVC over the center section 3 and head section 2 of the tag.

An insulating dielectric ink (not shown) may also be printed on the underside of the self-cling PVC over the tail section 4 of the tag to prevent shorting of the conductive track 5 where it is not covered by the adhesive backing. However, the dielectric ink would leave the terminal contacts 6, 7 exposed.

In use, the peelable backing paper is removed from the adhesive bottom layer 10 and the head and center section of the tag are adhesively bonded to the surface of an article being protected. The tail section 4 includes the terminal contacts 6, 7 through which the tag is connected to a monitoring circuit which monitors the resistance of the conductive track.

The bonding strength of the adhesive 10 is selected so that it is greater than the force required to stretch the head section 2 of the tag. Accordingly any attempt to pull the tag away from the surface to which it is bonded (or to pull the surface away from the tag) will result in the self-cling PVC 1 stretching in the necked region of the head section 2. This produces a further narrowing of the conductive track in this necked region and a consequent increase in resistance which is detected by the monitoring circuit. Maximum effect is ensured because a high proportion of the total resistance is concentrated in this section of the tag.

The stretching may be sufficient to fracture the conductive track and create an open circuit. If desired, this effect can be enhanced by reducing the amount of plasticizer in the ink forming the conductive track 5 so that the elasticity of the track is less than that of the self-cling PVC 1. Reduced plasticity ink can be achieved, for example, by increasing the amount of silver ink in an ink consisting of a combination of carbon and silver inks.

The open circuit and/or the change of resistance can be detected by the monitoring circuit to trigger an alarm when the resistance moves outside predetermined upper and lower limit values. Accordingly, attempts to circumvent the tag by shorting the terminal contacts will trigger the alarm as well as attempts to remove the tag from the article to which it is bonded.

Instead of bonding the adhesive 10 directly to the surface of an article being protected, the length of the tag would be significantly increased and then threaded through an aperture in the article and bonded back on itself. In this case, the adhesive 10 would bond to the underside of the tail section 4 of the tag. Such an arrangement would be particularly useful for protecting articles of clothing.

It will be understood that the bonding strength of an adhesive may increase with time after the adhesive is brought into contact with a surface, and references to bonding strength in the present description and claims refer to the bonding strength when an adhesive bond is initially formed with the surface. This may be lower than the final bonding strength.

What is claimed is:

1. A security tag for use in preventing theft of an article, the tag comprising an electrically conductive track (5) formed on a flexible substrate (1), a portion (2, 3) of the substrate including an adhesive backing (10) for bonding the substrate to a surface, the arrangement being such that, with the substrate (1) bonded to a surface, the conductive track (5) is stressed by an attempt to separate the substrate from the said surface, characterised in that the substrate is an elastic substrate and the conductive track (5) is elongated in response to stretching of the substrate, the force required to stretch the substrate being less than the adhesive bonding force holding the substrate against the said surface.

2. A security tag according to claim 1 wherein the substrate includes a tail portion (4) extending beyond the adhesive backed portion (2, 3).

3. A security tag according to claim 2 wherein, in use, the substrate is looped back on itself to bond the adhesive-backed portion (2, 3) to the underside of the tail portion (4).

4. A security tag according to claim 2 wherein a layer (8) of material having an elasticity less than that of the substrate is bonded to a portion (3) of the adhesive-backed portion (2, 3) of the substrate.

5. A security tag according to claim 4 in which the said layer (8) is interposed between the substrate (1) and the adhesive backing (10).

6. A security tag according to claim 4 in which the said layer (8) overlies the substrate (1) and the adhesive backing (10).

7. A security tag according to claim 1 wherein the said layer (8) is additionally bonded to the tail portion (4) of the substrate.

8. A security tag according to claim 5 wherein the said layer (8) is adhesively bonded to the underside of the substrate.

9. A security tag according to claim 1 wherein an electrical characteristic of the conductive track (5) is altered in response to the said elongation of the track.

10. A security tag according to claim 9 wherein the electrical characteristic is the resistance of the track.

11. A security tag according to claim 10 wherein the resistance of the track is varied along the length of the track.

12. A security tag according to claim 11 wherein the substrate is shaped such that stretching is concentrated in a region of the substrate containing a portion of the track having increased resistance.

13. A security tag according to claim 12 wherein the substrate is generally rectangular and the said region is formed by reducing the width of the substrate in the said region.

14. A security tag according to claim 13 in which the increased resistance of the track is achieved by reducing the width of the track in the said region of the substrate.

15. A security tag according to claim 1 wherein the conductive track is formed by printing a conductive ink on the substrate.

* * * * *